US005704235A

United States Patent [19]

Stähle

[11] Patent Number: 5,704,235

[45] Date of Patent: Jan. 6, 1998

[54] KEY CASE FOR AN IGNITION KEY

[76] Inventor: Kurt Stähle, Commingenstrasse 10, 75242 Neuhausen-Steinegg, Germany

[21] Appl. No.: 571,781

[22] Filed: Dec. 13, 1995

[30] Foreign Application Priority Data

Dec. 24, 1994 [DE] Germany ..... 44 46 556.4

[51] Int. Cl.[6] ..... A45C 11/32

[52] U.S. Cl. ..... 70/456 R; 70/408; 70/459; 206/37.1

[58] Field of Search ..... 206/37.1, 37.4, 206/37.6, 37.8, 38.1; 70/395, 396, 408, 456 B, 456 R, 459, 458

[56] References Cited

U.S. PATENT DOCUMENTS

| | | | |
|---|---|---|---|
| 301,804 | 7/1884 | Chevremont | 292/207 |
| 1,642,791 | 9/1927 | Skorepa | 70/456 R |
| 1,966,550 | 7/1934 | Handy | 70/460 |
| 2,467,614 | 4/1949 | Duyn | 70/456 R |
| 2,842,954 | 7/1958 | Schindler | 70/456 |
| 2,924,961 | 2/1960 | Pyper | 70/456 R |
| 3,004,422 | 10/1961 | Starrett | 70/456 R |
| 4,569,215 | 2/1986 | McCarthy | 70/456 R |
| 4,631,943 | 12/1986 | Hoener | 70/395 |
| 5,117,666 | 6/1992 | Keefer | 70/456 R |
| 5,215,190 | 6/1993 | Hoffpauir, Jr. | 206/37.4 |
| 5,457,976 | 10/1995 | Stillwagon | 70/456 R |
| 5,495,942 | 3/1996 | Izhak | 70/456 R |
| 5,517,839 | 5/1996 | Parsons | 70/456 R |

FOREIGN PATENT DOCUMENTS 41 05 113 C1 8/1992 Germany .

*Primary Examiner*—Darnell M. Boucher
*Attorney, Agent, or Firm*—Loeb & Loeb LLP

[57] ABSTRACT

A key case for holding a key, the key having a head portion via which the key may be gripped by a user and a blade portion which is insertable into a lock, the key case comprising: a body portion having a wall which surrounds an interior space, a longitudinal axis and an open end traversed by the longitudinal axis; a holder plate having a recess for retaining the key in a manner to prevent relative rotation between the key and the holder plate; and a pivot assembly supporting the holder plate on the body for movement between a first position in which the holder plate covers the open end and the key blade extends parallel to the longitudinal axis, and a second position in which the open end is uncovered.

7 Claims, 4 Drawing Sheets

KEY CASE FOR AN IGNITION KEY

BACKGROUND OF THE INVENTION

The invention relates to a key case for holding a key, the key having a head portion via which the key may be gripped by a user and a blade portion which is insertable into a lock.

Such key cases are used particularly to enable remote actuation of the ignition key using an additional device, as described for instance in German Patent De 41 05 113 C2 of the present applicant. Such a key case must essentially meet the demand of holding an ignition key so firmly, or rigidly, in terms of rotation that when the key case is rotated about a certain angle, the ignition key is rotated about the same angle. In the aforementioned device for remote-controlled actuation of the key, the key case is then connected via a force transmitting coupling, such as a chain or a toothed belt, with a separate device that then transmits the desired torque up to the particular rotational angle desired to the key case and hence to the ignition key.

However, such key cases are not limited in their use to the aforementioned device but instead can be used for other purposes as well.

In the previously known device, the key case comprises a substantially cylindrical component, which on its face end has a recess, or slit, through which the ignition key used is passed and is firmly held with respect to its angular position, while a spare key can be accommodated in the key located beneath it.

This structural design sometimes leads to inconvenience in inserting or removing the pair of keys, and sometimes it is also desired to actuate the ignition key in the conventional way, that is, but turning it via the handle part provided for that purpose.

SUMMARY OF THE INVENTION

It is therefore an object of the invention to provide a key case that offers these options of manipulation.

According to the invention, this object is attained by key case for holding a key, the key having a head portion via which the key may be gripped by a user and a blade portion which is insertable into a lock, the key case comprising: a body portion having a wall which surrounds an interior space, a longitudinal axis and an open end traversedby the longitudinal axis; a holder plate having a recess for retaining the key in a manner to prevent relative rotation between the key and the holder plate; and pivot means supporting the holder plate on the body for movement between a first position in which the holder plate covers the open end and the key blade extends parallel to the longitudinal axis, and a second position in which the open end is uncovered.

Preferred exemplary embodiments of a key case according to the invention will now be described in further detail in conjunction with the drawings.

DESCRIPTION OF THE PREFERRED EMBODIMENTS

Figure 1:
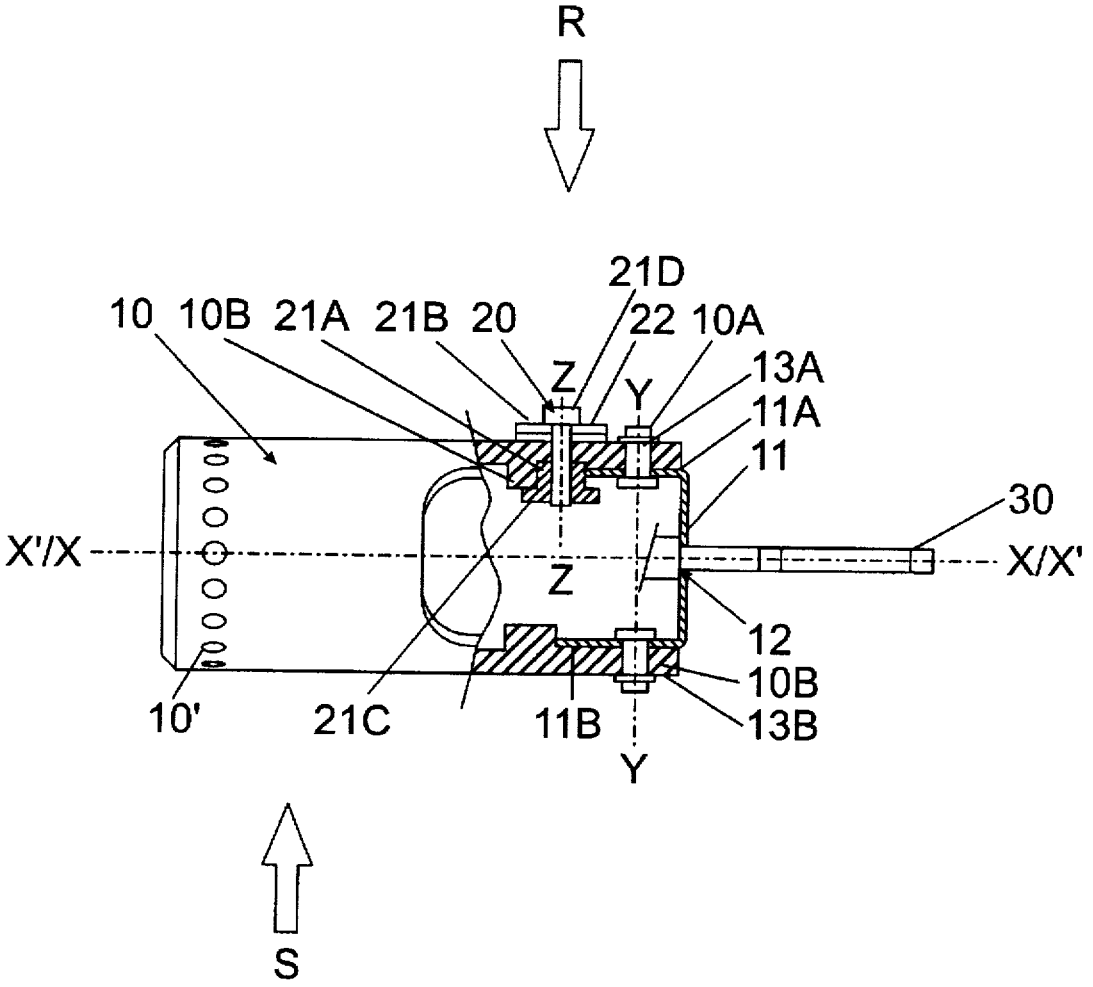
FIG. 1 is a side view, partly in cross section through the key case in a first plane which contains the longitudinal axis of the case.
Figure 2:
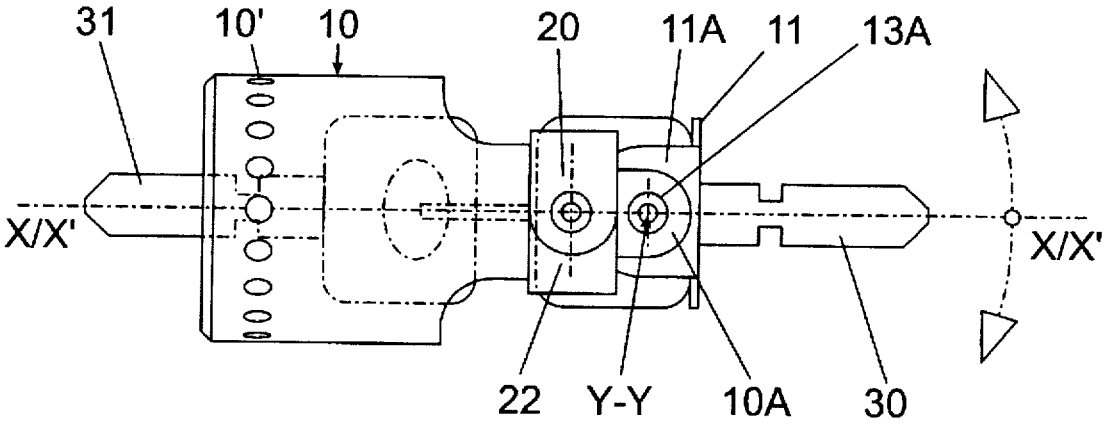
FIG. 2 is a side view in the direction of arrow S of FIG. 1, showing the key case with two keys inserted and in a first position.
Figure 3:
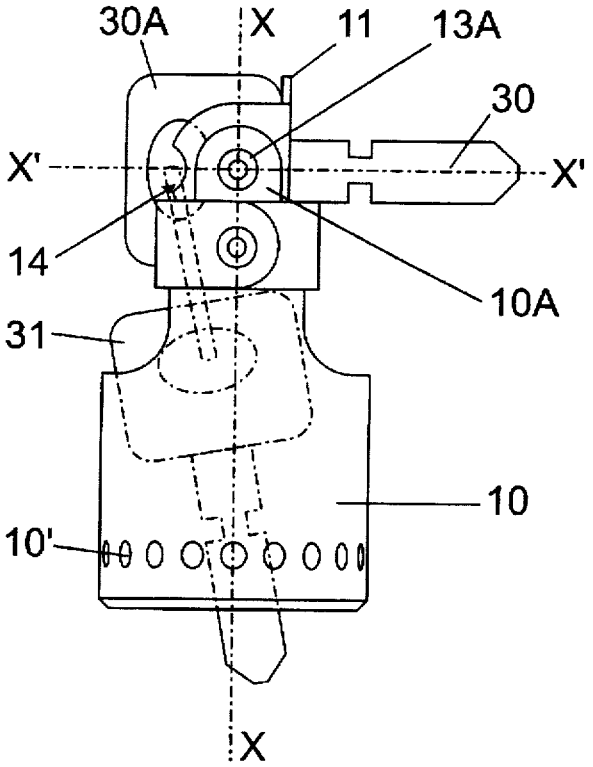
FIG. 3 is a side view in the same direction as FIG. 2 with the key case in a second position.

FIGS. 1–3 show a first embodiment of a key case according to the invention. This embodiment includes a housing, or body, 10 having a substantially cylindrical body portion. The body portion is provided with a circumferential row of holes 10' engageable with a drive element, such as a toothed belt, to rotate the key case about its axis X—X. For this purpose, the key case would be inserted into the appartus disclosed in DE 41 05 111 C2 at the location indicated by the reference numeral 1 in FIG. 1 of that patent. Then, the drive element would be placed around housing 10 and driven by an external motor to rotate the key case.

FIGS. 1 and 2 show the first position with a key 30 inserted into housing 10. The longitudinal axis X'—X' of the key 30 is here identical to the longitudinal axis X—X of the substantially cylindrical body portion of body 10. In this position, which will hereinafter be called the "function position", coupling can be done to an actuation device for turning the key, as shown for instance in the patent referred to above.

The face end (on the right in FIGS. 1 and 2) of the key case is formed by a U-shaped holder plate 11 which has a recess 12. In the exemplary embodiment shown, recess 12 is a lengthwise slit. Recess 12 assures that key 30 will rotate with plate 11. In the inserted position of the ignition key 30 shown in the drawings, the key when turned is rotated about the common longitudinal axis X or X'.

The legs 11A, 11B of the holder plate 11 are held via rotary bearings 13A, 13B on the correspondingly formed arms 10A, 10B of the key case, so that the ignition key 30 can be pivoted, in the direction shown with a double arrow in FIG. 2, about an axis of rotation Y—Y at right angles to the longitudinal axis X—X of the key case 10. The view of FIG. 2 shows the key case in a position rotated by 90° about longitudinal axis X—X compared with the view of FIG. 1.

A blocking device 20 is provided to maintain the coaxial orientation of the key 30 on the one hand and the key case 10 on the other despite this possibility of pivoting, or in other words to define the function position shown in FIGS. 1 and 2 and maintain it. An essential part of blocking device 20 is a locking pin 21, whose longitudinal axis Z—Z extends parallel to the pivot axis Y—Y of the holder plate 11 through an arm 10A of the key case. This blocking device 20 is designed such that it has a blocking position (shown in FIG. 1), in which it cooperates with the arm 11A of the plate 11 in such a way that it blocks the latter against pivoting. To that end, these components are embodied as follows, in the exemplary embodiment shown:

The locking pin 21 comprises a head 21D, an axial portion 21B, a detent portion 21A and an end portion 21C, which follow one another in this order inwardly from the outside (toward the longitudinal axis X—X). The head 21D is engaged from below by a folded leaf spring 22, so that without any exertion of external force, blocking device 20 is in its blocking position shown in FIG. 1. In this blocking position, a circular-arc-shaped recess 14 (FIG. 3) engagingly surrounds the lower end of the leg 10A of the cylindrical detent portion 21A, with the two radii substantially matching one another. In this position, the end part 21C is pressed against a bearing portion 10B of the arm 10A.

If key 30 is to be moved from the blocking position, then the locking device 20 is axially displaced by pressure upon the head 21D (in the direction of arrow R) far enough that the end recess 14 of the arm 11A comes out of engagement with the detent portion 21A. Since the axial portion 21B located between the detent portion 21A and the head 21D has a very much smaller diameter than the detent portion 21A, there is no longer any possibility of engagement with the arm 11A now, and this arm is thus pivotable out of the first position, if the head 21D is kept pressed counter to the action of the leaf spring 22. Unlocking of the holder plate 11 is thus possible in the simplest way.

Holder plate 11 can then be pivoted, for instance into the position shown in FIG. 3, where the longitudinal axis X'—X' of the key 30 is at right angles to the longitudinal axis X—X of body 10. In this position, there is easy access to the head portion 30A of key 30, and the inside of the cylindrical portion of the body 10 is also more readily accessible. In the relative position of the holder plate 11 and body 10 shown in FIG. 3, manual actuation of the ignition key in the ignition lock can take place, or else the ignition key in the ignition lock can take place, or else the ignition key 30 and a spare key 31, which as a rule are connected by way of a ring 34 or the like, can simply be introduced into the key case and removed again. The keys are inserted by placing key 31 within body 10 and then inserting the blade or key 30 through recess 12.

FIGS. 4–7 illustrate a second embodiment of a key case according to the invention which is constructed to be remotely actuated in a different manner than the embodiment of FIGS. 1–3.

The second embodiment of a key case according to the invention includes a body 110 supporting a key holding mechanism 112 which carries key 30. Mechanism 112 can be essentially identical to the mechanism constituted by elements 10A, 10B, 11, 11A, 11B, 13A, 13B, 14, 20, 21A–21D and 22 of the embodiment shown in FIGS. 1–3.

Body 110 is provided with a base 114 provided with a recess that is shaped to receive a coupling element 118. The recess in base 114 and coupling element may have, for example, mating hexagonal forms to cause the key case to rotate together with element 118.

Element 118 is fixed to one end of a flexible shaft P, and the other end of shaft P is secured to the shaft of a motor M. Motor M is supported by a suitable support device H that may be fastened, for example, on the driver's seat of an automotive vehicle.

Figure 4:
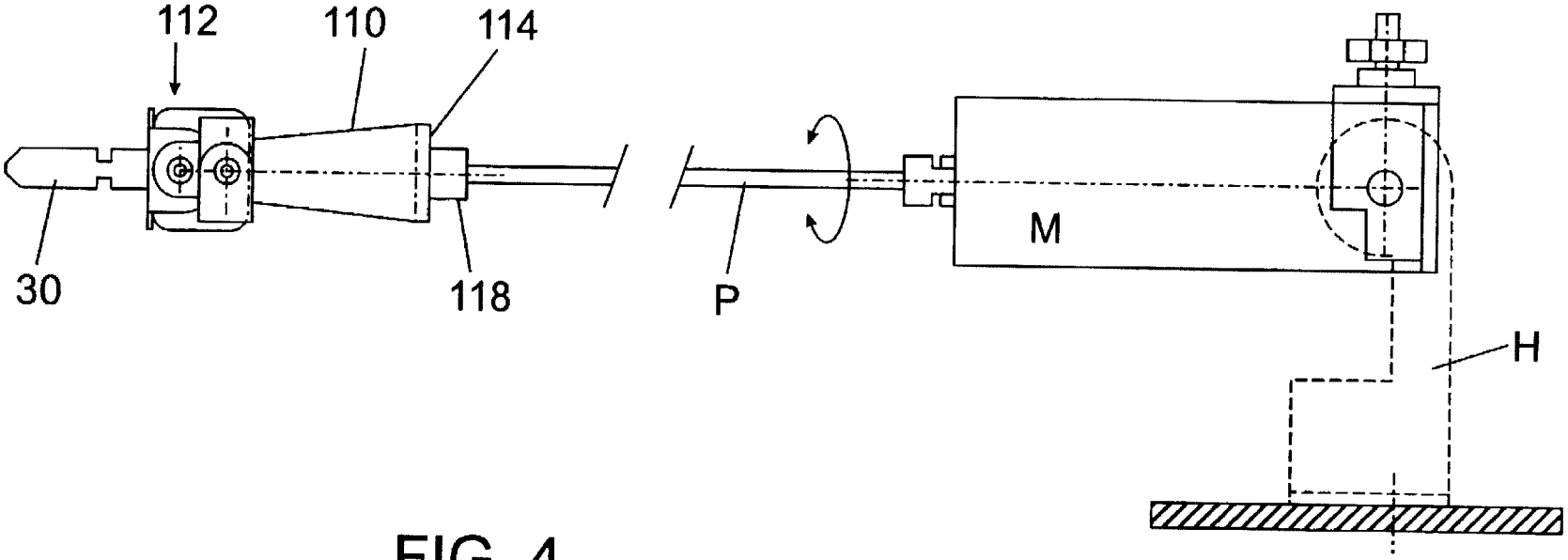
FIG. 4 is an elevational view of a second embodiment of a key case according to the invention connected to an actuation system.
Figure 5:
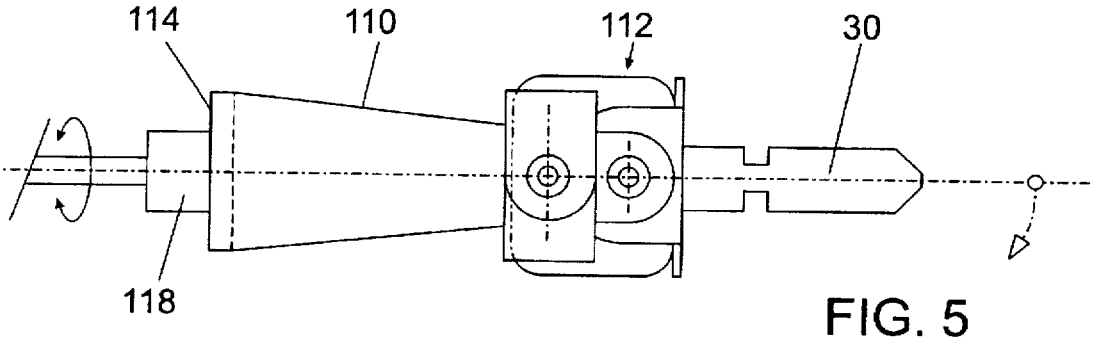
FIG. 5 is a side view of the second embodiment in a first position.
Figure 6:
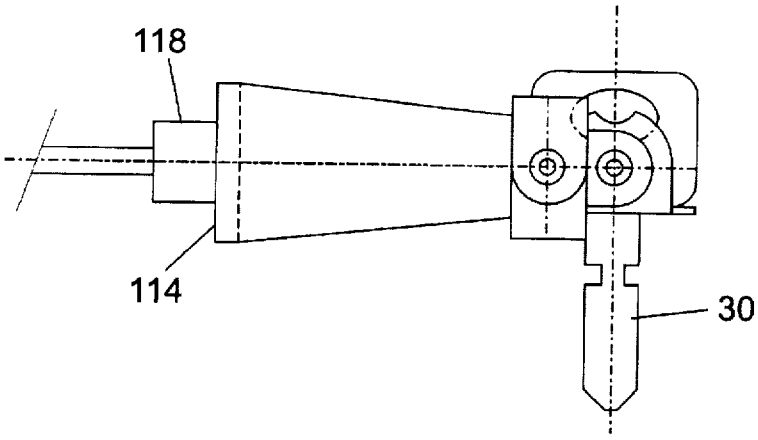
FIG. 6 is a side view of the second embodiment in a second position.

In FIGS. 4 and 5, key 30 is in a first position, corresponding to the position shown in FIGS. 1 and 2, while in FIG. 6, key 30 is in a second position corresponding to the position shown in FIG. 3.

Figure 7:
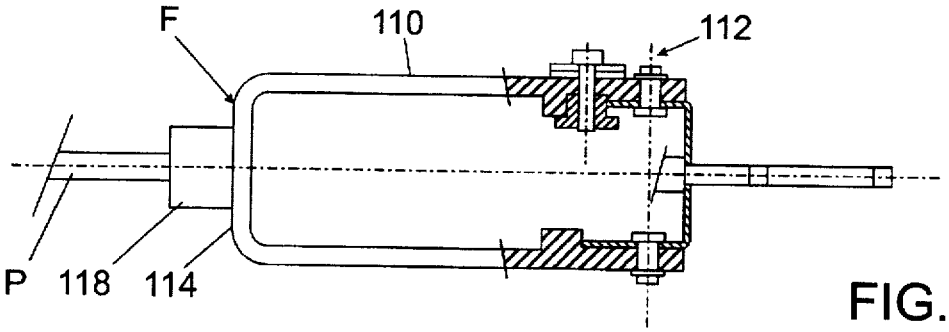
FIG. 7 is a side view in a direction perpendicular to the view of FIG. 5.

In view of the manner in which body 110 is connected for remote actuation, it need not have a cylindrical form and can, as shown in FIG. 7, be constituted by a simple U-shaped part whose legs support mechanism 112 at the ends of those legs which are remote from base 114.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A key case for holding a key, the key having a head portion via which the key may be gripped by a user and a blade portion which is insertable into a lock, said key case comprising: a body portion having a wall which surrounds an interior space, a longitudinal axis, an open end traversed by the longitudinal axis and two spaced arms that extend parallel to said longitudinal axis; a holder plate for retaining the key in a manner to prevent relative rotation between the key and said holder plate; pivot means supporting said holder plate on said body portion for movement between a first position in which the key blade extends parallel to said longitudinal axis, and a second position in which said open end is uncovered said holder plate being constructed and coupled to said body portion, for assuring rotation of the key as a unit with said body portion about the longitudinal axis when said holder plate is in the first position, said holder plate having two spaced arms that extend parallel to one another and that are connected to said two spaced arms of said body portion by said pivot means; and a blocking device associated with said pivot means for securing said holder plate in the first position, wherein said blocking device comprises a locking pin movable into a blocking position for engaging one arm of said holder plate to secure said holder plate in the first position and said pivot means supports said holder plate for pivotal movement about a pivot axis and said locking pin is movable parallel to the pivot axis.

2. A key case as defined in claim 1 wherein said base is provided with an element for coupling to a remote actuation system.

3. A key case as defined in claim 1 wherein said blocking device further comprises a spring mounted to urge said pin in said blocking position, and said pin is movable away from said blocking position, into a release position, which permits movement of said holder plate to said second position.

4. A key case for holding a key, the key having a head portion via which the key may be gripped by a user and a blade portion which is insertable into a lock, said key case comprising a body portion having a wall which surrounds an interior space, a longitudinal axis, an open end traversed by the longitudinal axis and two spaced arms that extend parallel to said longitudinal axis; a holder plate for retaining the key in a manner to prevent relative between the key and said holder plate; pivot means supporting said holder plate on said body portion for movement between a first position in which the key blade extends parallel to said longitudinal axis, and a second position in which said open end is uncovered said holder plate being constructed, and coupled to said body portion, for assuring rotation of the key as a unit with said body portion about the longitudinal axis when said holder plate is in the first position, said holder plate having two spaced arms that extend parallel to one another and that are connected to said two spaced arms of said body portion by said pivot means; and a blocking device associated with said pivot means for securing said holder plate in the first position, wherein said blocking device comprises a locking pin movable into a blocking position for engaging one arm of said holder plate to secure said holder plate in the first position and said locking pin has: a detent portion which engages said one arm when said locking pin is in said blocking position; and an outwardly directed axial portion which is in line with said one arm when said pin is moved away from said blocking position, said axial portion being dimensioned to be out of contact with said one arm to allow said one arm to pivot to said second position.

5. A key case as defined in claim 4 wherein said blocking device further comprises a spring mounted to urge said pin in said blocking position, and said pin is movable away from said blocking position, into a release position, which permits movement of said holder plate to said second position.

6. A key case as defined in claim 5 wherein said pivot means supports said holder plate for pivotal movement about a pivot axis and said locking pin is movable parallel to the pivot axis.

7. A key case as defined in claim 4 wherein said base is provided with an element for coupling to a remote actuation system.

* * * * *